US007414208B1

(12) United States Patent
Vergari et al.

(10) Patent No.: US 7,414,208 B1
(45) Date of Patent: Aug. 19, 2008

(54) ULTRA LOW PRESSURE SWITCH ADJUSTMENT SYSTEM

(75) Inventors: Mark S. Vergari, Oneonta, NY (US); Felix M. Castro, Dallas, GA (US)

(73) Assignee: Mold-a-Matic Corp., Oneonta, NY (US)

( * ) Notice: Subject to any disclaimer, the term of this patent is extended or adjusted under 35 U.S.C. 154(b) by 43 days.

(21) Appl. No.: 11/555,299

(22) Filed: Nov. 1, 2006

(51) Int. Cl.
*H01H 35/34* (2006.01)

(52) U.S. Cl. ..... 200/83 R; 200/83 P; 200/83 S; 200/83 SA

(58) Field of Classification Search ..... 200/81 R, 200/83 R, 83 A, 83 J, 83 N, 83 P, 83 S, 83 SA, 200/83 V, 83 W; 73/715
See application file for complete search history.

(56) References Cited

U.S. PATENT DOCUMENTS 3,525,262 A * 8/1970 Goran, Jr. ..... 73/725
3,689,719 A * 9/1972 Phillips et al. ..... 200/83 P
4,194,103 A * 3/1980 Smith ..... 200/456
4,215,254 A * 7/1980 Ohki ..... 200/83 C
4,410,776 A * 10/1983 Stoll ..... 200/83 P
5,120,915 A * 6/1992 Doherty ..... 200/83 J
5,187,338 A * 2/1993 Kaigler ..... 200/83 R
5,304,759 A * 4/1994 Doherty ..... 200/83 SA
6,040,536 A * 3/2000 Miller et al. ..... 200/83 N
6,346,681 B1 * 2/2002 Joyce et al. ..... 200/83 S
6,495,777 B1 * 12/2002 Chou ..... 200/83 R
7,071,430 B2 * 7/2006 Farano et al. ..... 200/81.4

* cited by examiner

*Primary Examiner*—Michael A Friedhofer
(74) *Attorney, Agent, or Firm*—Michael S. Neustel

(57) ABSTRACT

An ultra low pressure switch adjustment system for efficiently differentiating between varying triggering pressures. The ultra low pressure switch adjustment system generally includes a housing including a first aperture and a second aperture, wherein said housing is comprised of a first portion and a second portion, wherein said first portion and said second portion define a cavity between thereof, a first terminal positioned within said cavity, a first adjustment member to engage said first terminal, wherein said first adjustment member extends through said first aperture, a second terminal positioned within said cavity and a second adjustment member to engage said second terminal, wherein said second adjustment member extends through said second aperture.

18 Claims, 11 Drawing Sheets

ULTRA LOW PRESSURE SWITCH ADJUSTMENT SYSTEM

CROSS REFERENCE TO RELATED APPLICATIONS

Not applicable to this application

STATEMENT REGARDING FEDERALLY SPONSORED RESEARCH OR DEVELOPMENT

Not applicable to this application

BACKGROUND OF THE INVENTION

1. Field of the Invention

The present invention relates generally to pressure switches and more specifically it relates to an ultra low pressure switch adjustment system for efficiently differentiating between varying triggering pressures.

2. Description of the Related Art

Any discussion of the prior art throughout the specification should in no way be considered as an admission that such prior art is widely known or forms part of common general knowledge in the field.

Pressure switches have been in use for years. Typically, low pressure switches utilize a deflecting beam contact and a stationary contact, wherein a desired pressure will move the deflecting beam contact downward against the stationary contact thus completing a circuit. The prior pressure switches are generally constructed using a plastic housing. The plastic housing generally includes an adjustment mechanism passing through the housing and making contact with stationary contact. Adjustment of the adjustment mechanism generally allows the switch to engage at various pressures depending on the placement of the adjustment mechanism.

Variations in pressures that may be utilized to trigger the switch are generally very minimal. The prior adjustment mechanism generally allows the pressure switch to be triggered at smaller pressures than the normal triggering pressure. The pressure switches generally do not accommodate for differentiating between larger pressures than the normal triggering pressure. This can lead to added cost in that you must buy several pressure switches to accommodate for environments with varying pressures that are desired to be tested.

In the past prior pressure switches have been calibrated before hand to accommodate for these varying pressures. This calibration generally takes an absorbent amount of time and can be a hassle it that it is generally difficult to calibrate a pressure switch.

Environments in which the pressure switches are utilized in generally are very inconsistent. The need to have a pressure switch that can differentiate and be triggered between varying pressures is necessary to avoid added cost and the time it takes to calibrate a pressure switch. Because of the general lack of efficiency and practicality in the prior art there is the need for a new and improved ultra low pressure switch adjustment system for efficiently differentiating between varying pressures.

BRIEF SUMMARY OF THE INVENTION

The general purpose of the present invention is to provide an ultra low pressure switch adjustment system that has many of the advantages of the pressure switches mentioned heretofore. The invention generally relates to a pressure switch which includes a housing including a first aperture and a second aperture, wherein said housing is comprised of a first portion and a second portion, wherein said first portion and said second portion define a cavity between thereof, a first terminal positioned within said cavity, a first adjustment member to engage said first terminal, wherein said first adjustment member extends through said first aperture, a second terminal positioned within said cavity and a second adjustment member to engage said second terminal, wherein said second adjustment member extends through said second aperture.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide an ultra low pressure switch adjustment system for efficiently differentiating between varying pressures.

Another object is to provide an ultra low pressure switch adjustment system that is small in size.

An additional object is to provide an ultra low pressure switch adjustment system that is not affected by temperature changes.

Another object is to provide an ultra low pressure switch adjustment system that is low in cost.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
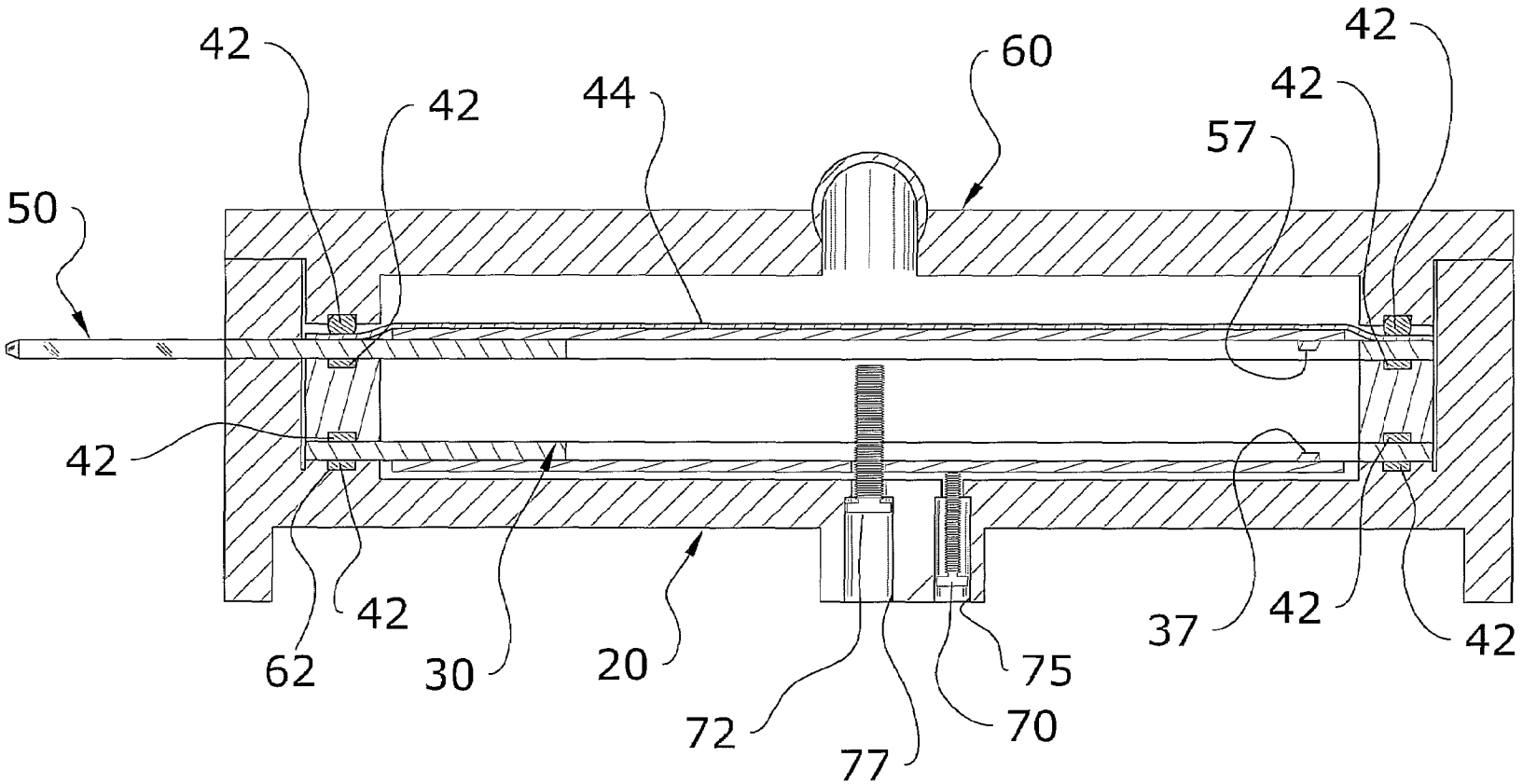
FIG. 1 is a side cross-sectional view of the present invention in a first position.

Turning now descriptively to the drawings, in which similar reference characters denote similar elements throughout the several views, FIGS. 1 through 11 illustrate an ultra low pressure switch adjustment system 10, which comprises a housing 20, 60 including a first aperture 74 and a second aperture 76, wherein said housing 20, 60 is comprised of a first portion 20 and a second portion 60, wherein said first portion 20 and said second portion 60 define a cavity 23 between thereof, a first terminal 30 positioned within said cavity 23, a first adjustment member 70 to engage said first terminal 30, wherein said first adjustment member 70 extends through said first aperture 74, a second terminal 50 positioned within said cavity 23 and a second adjustment member 72 to engage said second terminal 50, wherein said second adjustment member 72 extends through said second aperture 76.

B. First Housing Portion

Figure 3:
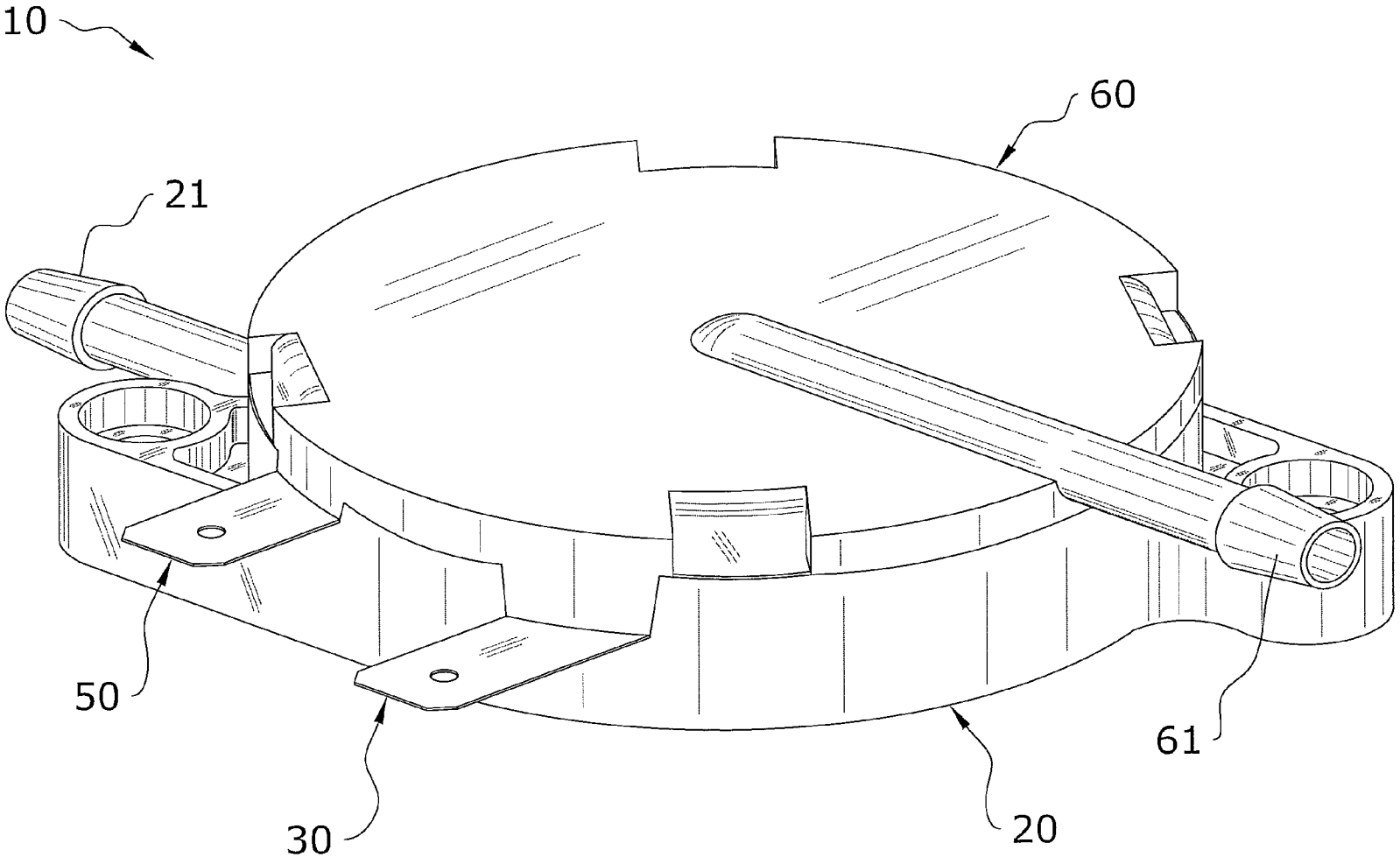
FIG. 3 is an upper perspective view of the present invention.
Figure 4:
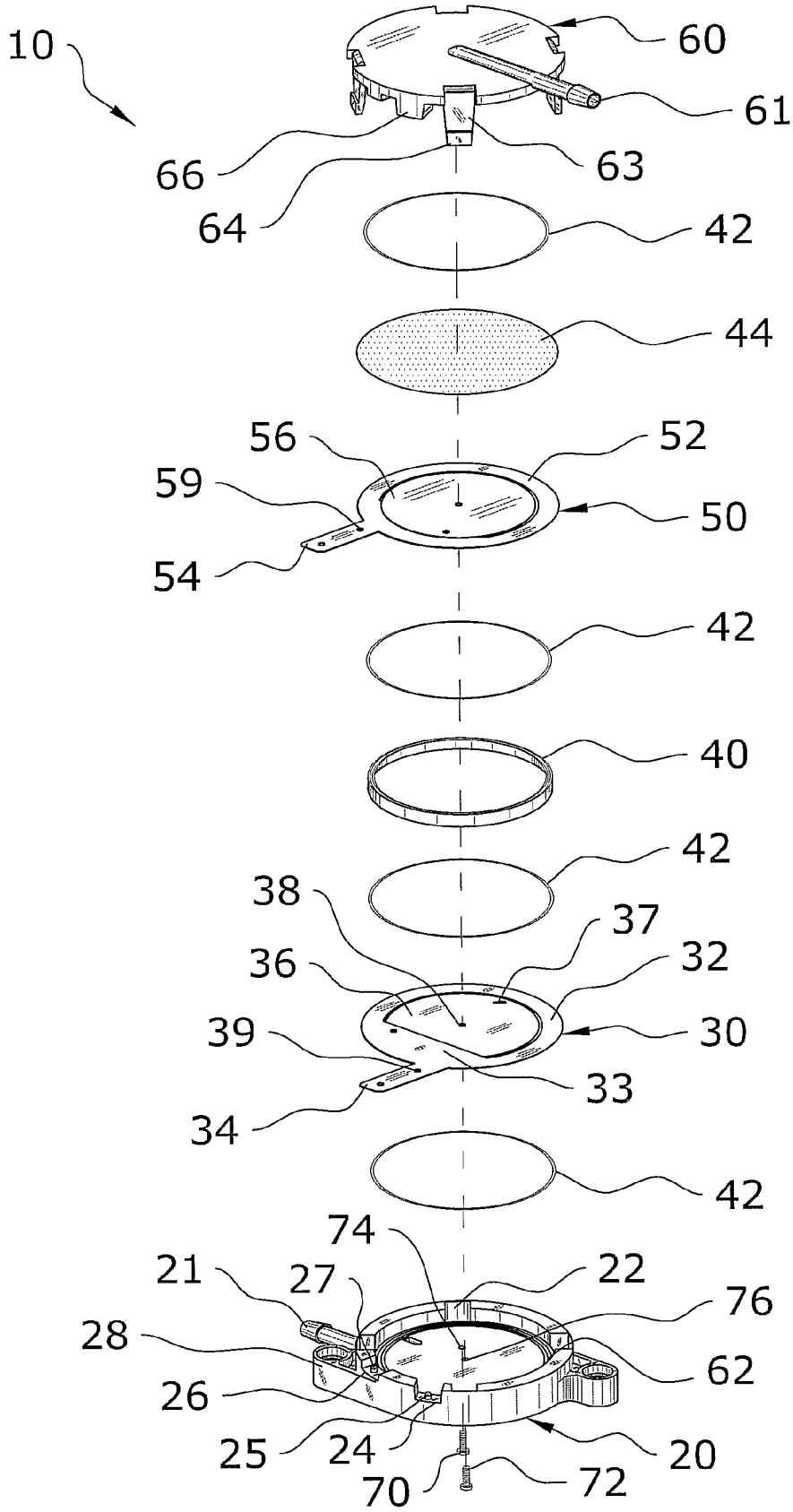
FIG. 4 is an exploded upper perspective view of the present invention.

The first housing portion 20 is preferably comprised of a substantially circular configuration as illustrated in FIGS. 3 and 4; however it is appreciated that the first housing portion 20 may be comprised of various configurations rather than the preferred embodiment, such as but not limited to elliptical or rectangular. The first housing portion 20 is preferably comprised of a material to withstand variant temperatures and pressures. The first housing portion 20 is also preferably able to expand and contract accordingly with variant environment conditions. The material of the first housing portion 20 is further preferably comprised of plastic; however other suitable materials may be utilized with the first housing portion 20 rather than the preferred material.

The first housing portion 20 includes a first port 21, wherein the first port 21 preferably receives a first pressure. The first port 21 is preferably comprised of a tubular configuration. The first port 21 also preferably extends horizontally outward from the first housing portion 20 as illustrated in FIGS. 3 through 6. The first port 21 is also preferably fluidly connected to an inner portion of the first port 21. The first pressure of the first port 21 is preferably comprised of a vacuum pressure.

The first housing portion 20 also includes at least one mounting member 28 as shown in FIGS. 3 through 6. The mounting member 28 preferably extends horizontally outward from the first housing portion 20. There preferably exists a mounting member 28 on each opposing side of the first housing portion 20. The mounting members 28 also preferably each receive a screw or other fastener to fasten the ultra low pressure switch adjustment system 10 to an object.

Figure 6:
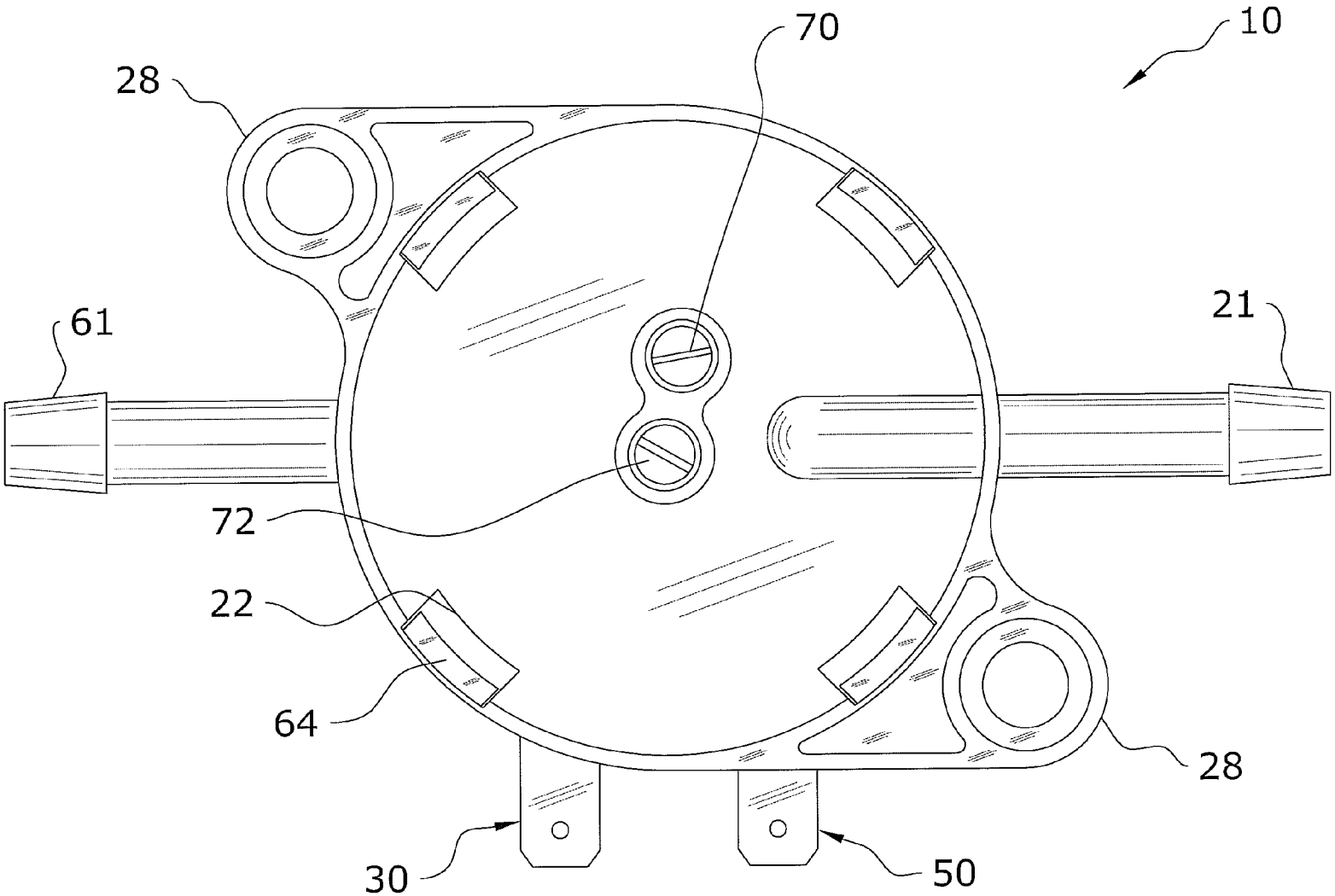
FIG. 6 is a bottom view of the present invention.

The first housing portion 20 also preferably includes a plurality of slots 22. The plurality of slots 22 preferably vertically extends through the first housing portion 20. The plurality of slots 22 are also preferably radially positioned substantially near an outer edge of the first housing portion 20 as shown in FIG. 6.

An outer wall of the first housing portion 20 preferably includes a first receiving portion 24 and a second receiving portion 26. The first receiving portion 24 and the second receiving portion 26 preferably both form a depression along the outer wall of the first housing portion 20 as illustrated in FIG. 4. The first receiving portion 24 is preferably at a substantially lower vertical height than the second receiving portion 26. The first receiving portion 24 and the second receiving portion 26 are also both preferably comprised of a rectangular configuration; however it is appreciated that the first receiving portion 24 and the second receiving portion 26 may be comprised of various configurations rather than the preferred embodiment.

Extending vertically upward from the first receiving portion 24 is preferably a first connecting member 25. A second connecting member 27 also preferably extends vertically upward from the second receiving portion 26. The first connecting member 25 and the second connecting member 27 are both preferably comprised of a pin configuration. A first width of the first connecting member 25 and a second width of the second connecting member 27 are each preferably substantially less than a width of the outer wall of the first housing portion 20 as shown in FIG. 4.

The first housing portion 20 also includes a cavity 23. The cavity 23 of the first housing portion 20 is preferably comprised of a circular configuration. The cavity 23 of the first housing portion 20 preferably extends within the first housing portion 20 to receive the first terminal 30, the plurality of seal members 42, the spacer member 40, the diaphragm member 44 and the second terminal 50. An outer diameter of the cavity 23 is preferably substantially similar to an outer diameter of the first outer member 32 of the first terminal 30 and to an outer diameter of a second outer member 52 of the second terminal 50.

The first housing portion 20 also preferably includes a first adjustment member 70 and a second adjustment member 72. The first adjustment member 70 and the second adjustment member 72 are preferably removably attached to a lower end of the first housing portion 20. The first adjustment member 70 and the second adjustment member 72 are also preferably threadably formed within the first housing portion 20 as illustrated in FIGS. 1 and 2.

Figure 2:
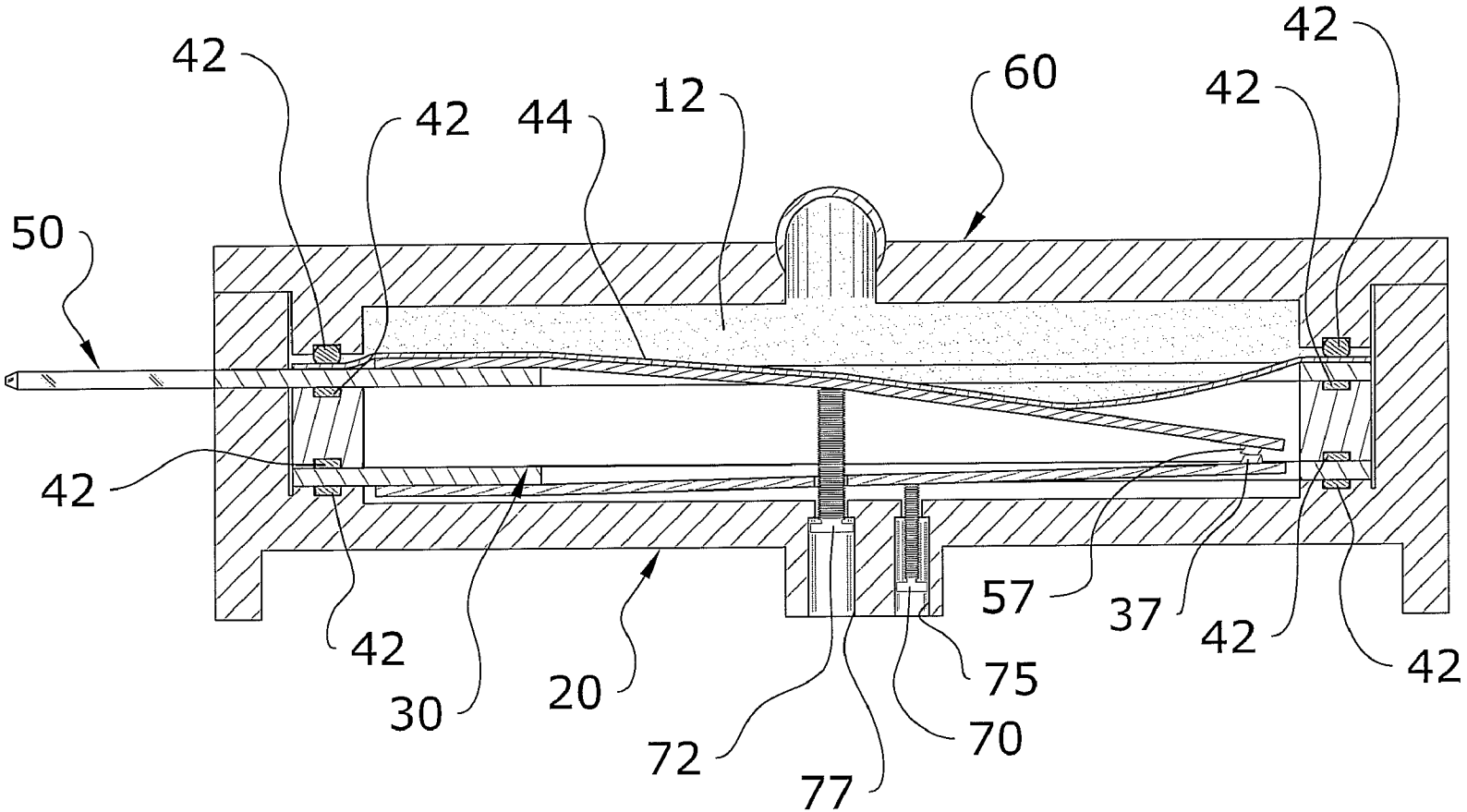
FIG. 2 is a side cross-sectional view of the present invention in use while in the first position.
Figure 9:
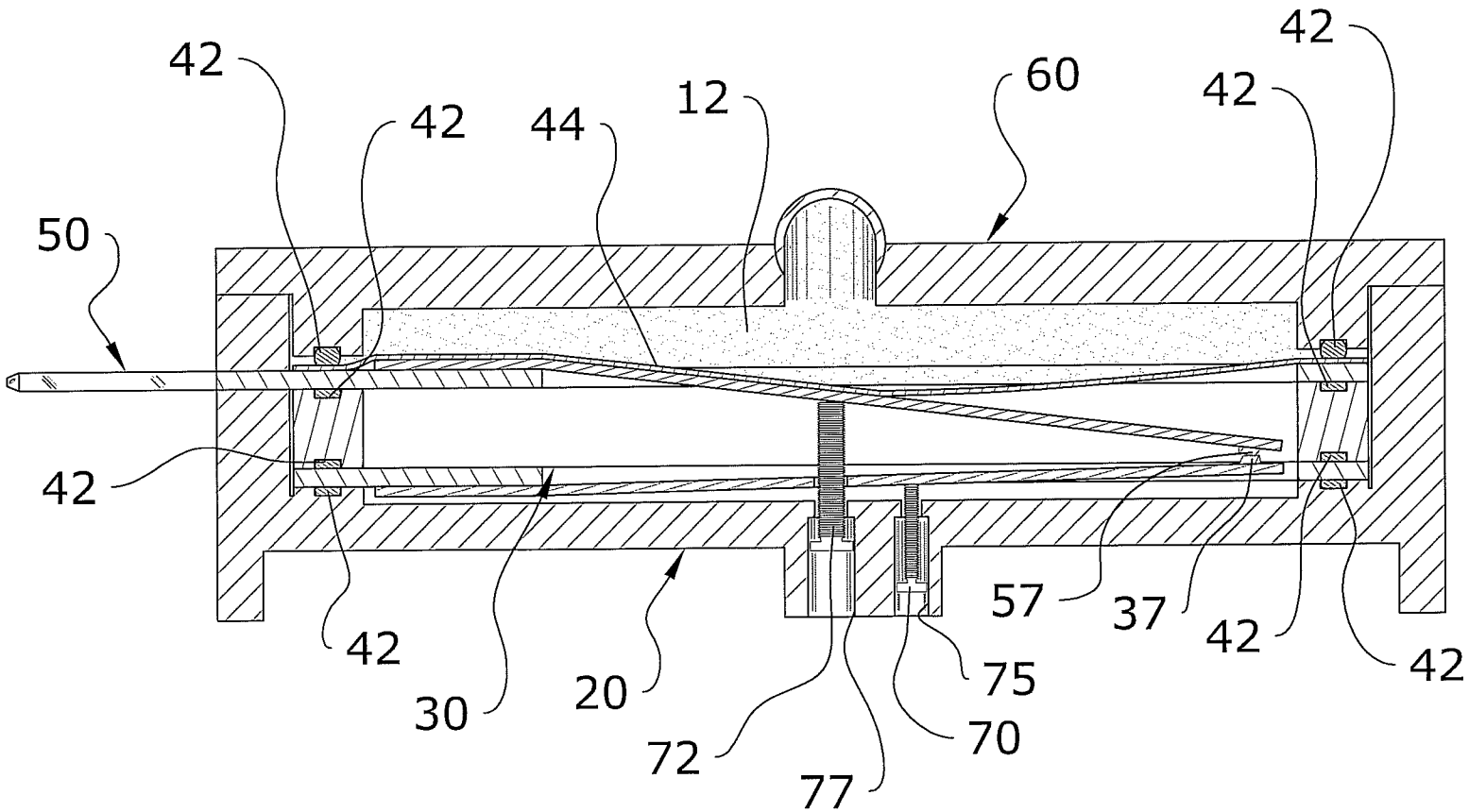
FIG. 9 is a side cross-sectional view of the present invention in use while in the second position.

The first adjustment member 70 preferably extends through a first recessed portion 75 and subsequently a first aperture 74 in the first housing portion 20 as illustrated in FIGS. 1, 2 and 4. The first adjustment member 70 may be threadably adjusted so as to engage the first terminal 30 as shown in FIGS. 2 and 9. Further, when the first adjustment member 70 engages the first terminal 30 the first adjustment member 70 is preferably positioned against the first inner 36 member of the first terminal 30. The first adjustment member 70 is preferably perpendicularly oriented with the first terminal 30 so as to prevent the first terminal 30 from slipping upon the first adjustment member 70.

The first inner member 36 is forced towards the second inner member 56 via the first adjustment member 70 and thus forms a first pivot point substantially near the first fulcrum portion 33 as illustrated in FIG. 2. When the first adjustment member 70 is threaded upwards beyond a common plane of the first terminal 30 the first adjustment member 70 forces the first inner member 36 upwards thus forcing the first contact 37 closer to the second contact 57.

Forcing the first contact 37 closer to the second contact 57 of the second terminal 50 allows the second contact 57 to engage the first contact 37 at a lower fluid 12 pressure than a normal fluid 12 pressure utilized with the ultra low pressure switch adjustment system 10. If the triggering pressure of the fluid 12 is desired to be raised or remain at the normal set triggering pressure the first adjustment member 70 is preferably threadably positioned within the first recessed portion 75 so as not to come in contact with the first terminal 30 as illustrated in FIG. 11.

Figure 7:
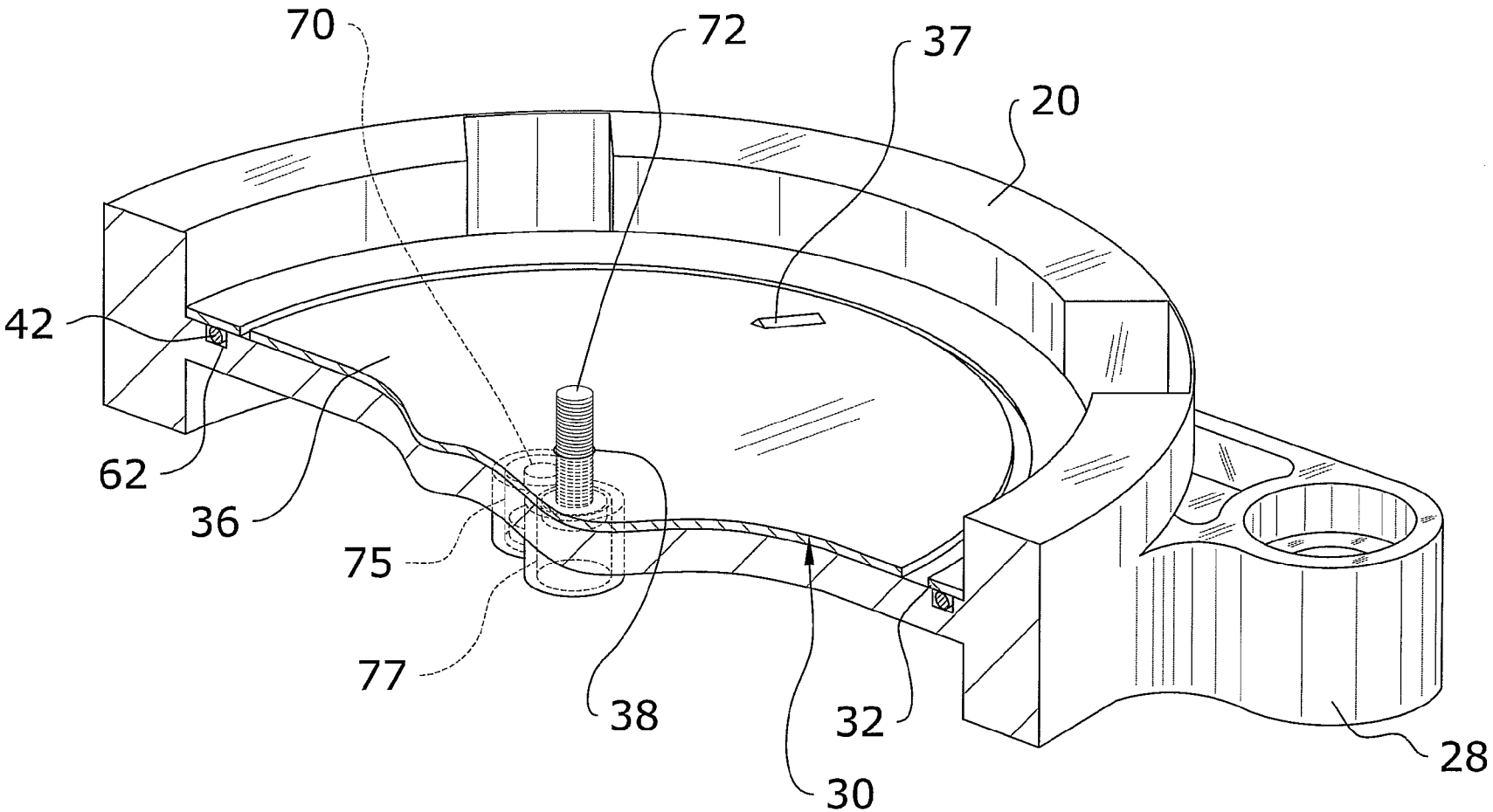
FIG. 7 is an upper perspective cutaway view of the present invention.

The second adjustment member 72 preferably extends through a second recessed portion 77 and subsequently a second aperture 76 of the first housing portion 20 as illustrated in FIGS. 1, 2 and 4. The second adjustment member 72 further preferably extends through a third aperture 38 in the first terminal 30 as shown in FIG. 7. The third aperture 38 of the first terminal 30 is preferably concentric with the first terminal 30. The second adjustment member 72 is preferably threadably adjusted substantially near the second terminal 50 opposite the diaphragm member 44.

Figure 8:
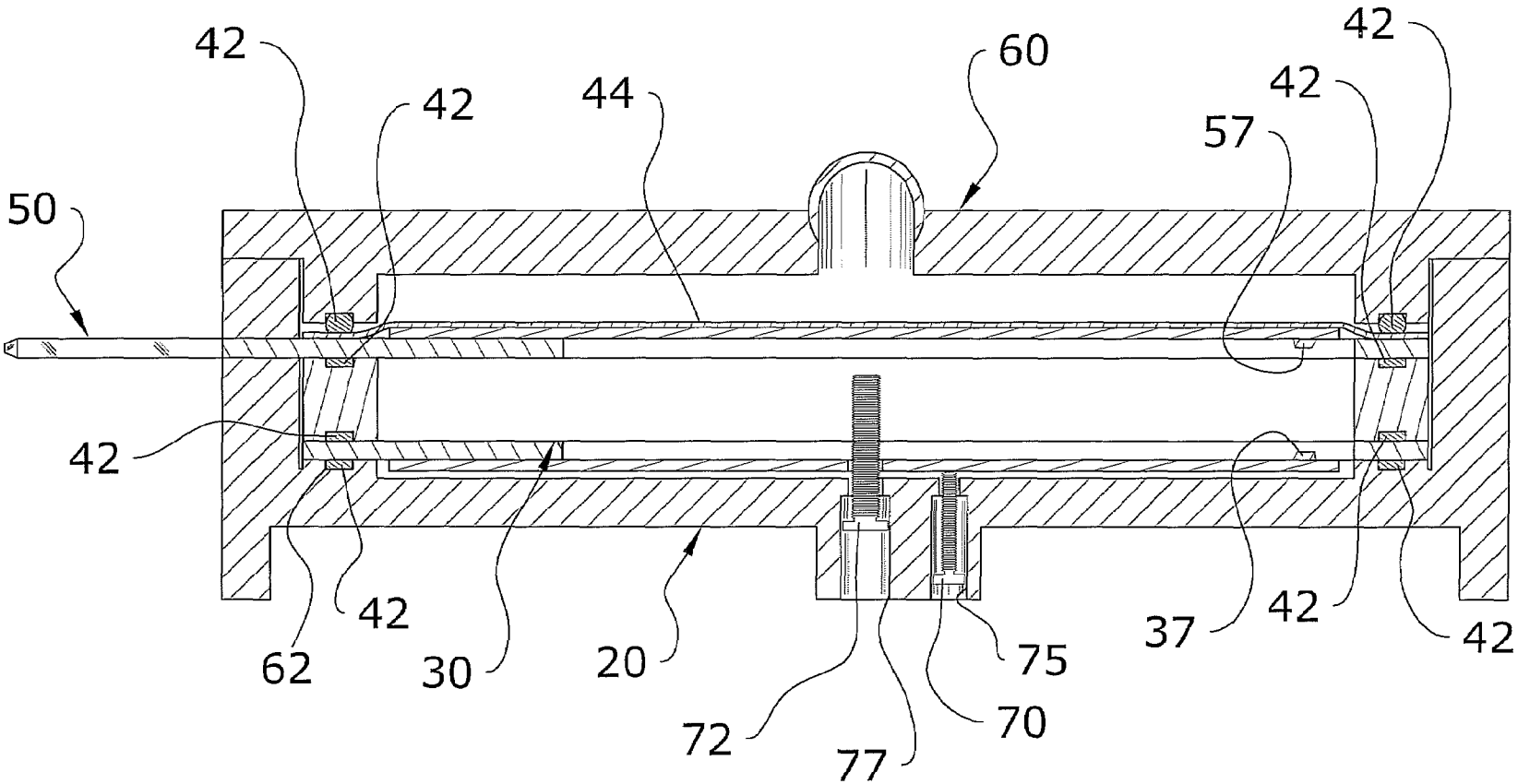
FIG. 8 is a side cross-sectional view of the present invention in a second position.
Figure 10:
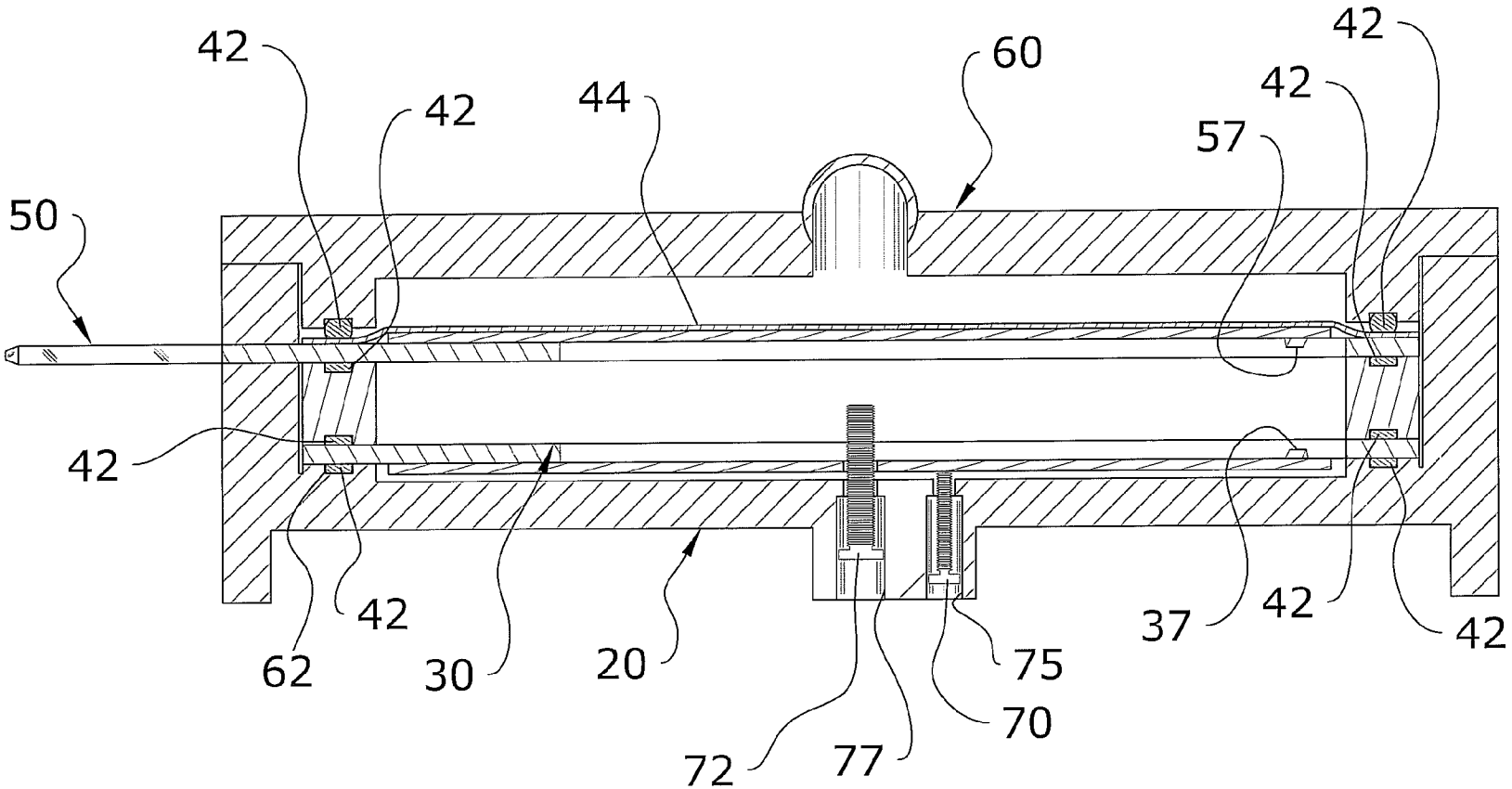
FIG. 10 is a side cross-sectional view of the present invention in a third position.

The second adjustment member 72 is preferably perpendicularly oriented with the second terminal 50 so as to prevent the second terminal 50 from slipping upon the second adjustment member 72. Further, the second adjustment member 72 may extend substantially towards the second inner 56 member of the second terminal 50 when the triggering pressure is desired to be raised as illustrated in FIGS. 1 and 2. If the triggering pressure of the fluid 12 is desired to be lowered or remain at the normal set triggering pressure the second adjustment member 72 is preferably threadably positioned within the second recessed portion 77 so as not to come in contact with the second terminal 50 as illustrated in FIGS. 10 and 11. The second adjustment member 72 is further adjustable to a variety of positions within the cavity 23 as illustrated in FIGS. 8 and 9.

Figure 11:
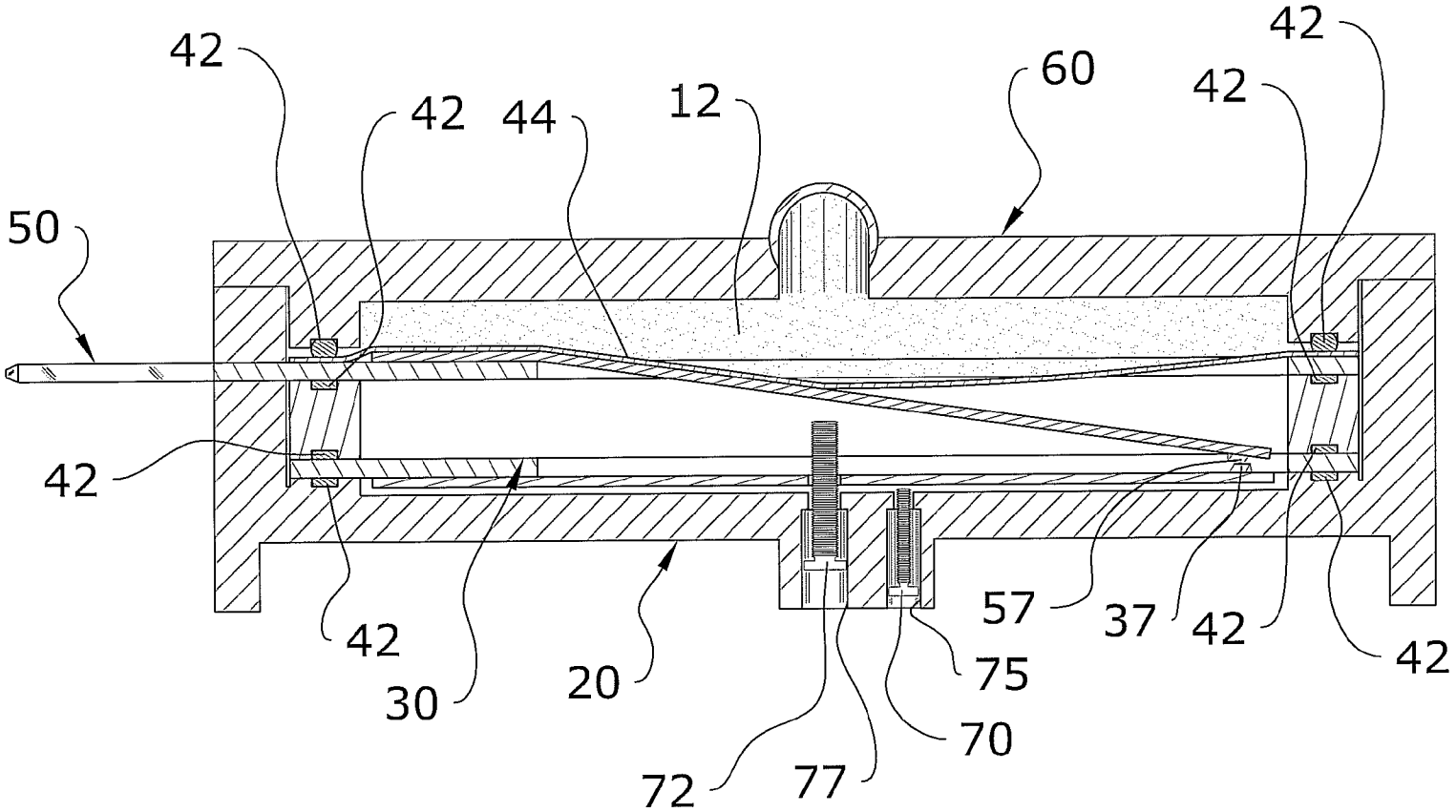
FIG. 11 is a side cross-sectional view of the present invention in use while in the third position.

The second inner member 56 is forced via the fluid 12 towards the first inner member 36 and thus forms a second pivot point substantially near a second fulcrum portion 53 as illustrated in FIGS. 2, 9 and 11. If the second adjustment member is adjusted in a raised position, when the second terminal 50 is forced downward by the fluid 12 the second inner member 56 of the second terminal 50 engages the second adjustment member 72 before the second contact 57 engages the first contact 37 as illustrated in FIGS. 2 and 9.

The second adjustment member 72 thus temporality prevents the second inner member 56 from moving further towards the first inner member 36. An increased pressure is needed once the second inner member 56 engaged by the second adjustment member 72 to further force the second inner member 56 downward and thus force the second contact 57 to be positioned against the first contact 37. The second adjustment member 72 forms a third pivot point about the second inner member 56 when the second inner member 56 engages the second adjustment member 72 as illustrated in FIG. 2. The third pivot point is preferably formed near a substantial center of the second inner member 56 as shown in FIG. 2.

C. First Terminal

The first terminal 30 is preferably comprised of a substantially circular configuration; however it is appreciated that the first terminal 30 may be comprised of various configurations rather than the preferred embodiment, such as but not limited to elliptical or rectangular. The first terminal 30 is also preferably positionable within the cavity of the first housing portion 20 as illustrated in FIGS. 1, 2 and 4. The first terminal 30 is preferably comprised of a metal material. The first terminal 30 is further preferably comprised of an electrically conductive material.

The first terminal 30 preferably includes a first outer member 32 and a first inner member 36. The first outer member 32 is preferably comprised of a ring configuration as shown in FIG. 4. The first outer member 32 is further preferably comprised of a hard metal material so as not to bend or deform over extended use. An outer diameter of the first outer member 32 is preferably substantially similar to an outer diameter of the cavity 23.

The first outer member 32 preferably includes a first extended portion 34 and a first fulcrum portion 33. The first extended portion 34 preferably extends outwardly to form the first outer member 32. The first extended portion 34 is further preferably comprised of a rectangular configuration. The first extended portion 34 is preferably positionable within the first receiving portion 24 of the first housing portion 20.

The first outer member 32 also preferably includes a first connecting aperture 39. The first connecting aperture 39 extends through the first extended portion 34. The first connecting aperture 39 further preferably aligns with the first connecting member 25 and is positionable over the first connecting member 25 thus securing the first terminal 30 within the first housing portion 20 as illustrated in FIG. 4.

The first outer member 32 also preferably includes a first fulcrum portion 33. The first fulcrum portion 33 preferably extends across the first outer member 32. The first fulcrum portion 33 preferably provides an overlapping region for the first inner member 36 to attach to the first outer member 32.

The first inner member 36 is preferably comprised of a circular configuration. An outer diameter of the first inner member 36 is also preferably slightly less than an inner diameter of the first outer member 32. The first inner member 36 is also preferably comprised of a brass material; however other materials may be utilized with the first inner member 36 rather than the preferred material.

The first inner member 36 is preferably spot welded to the first fulcrum portion 33 of the first outer member 32. Utilizing weld substance as a fastener between the first inner member 36 and the first outer member 32 preferably prevents the first inner member 36 from becoming loose upon the first outer member 32 over extended use. A concentric origin of the first inner member 36 is also preferably substantially similar to a concentric origin of the first outer member 32 when attaching the first inner member 36 to the first outer member 32.

The first inner member 36 also preferably includes a first contact 37. The first contact 37 preferably extends upward from an outer edge of the first inner member 36. The first inner member 36 is also preferably attached to the first outer member 32 in a manner, wherein an electrical current is able to flow between the first contact 37 and the first extended portion 34 of the first outer member 32.

D. Second Terminal

The second terminal 50 is preferably comprised of a substantially circular configuration; however it is appreciated that the first terminal 30 may be comprised of various configurations rather than the preferred embodiment, such as but not limited to elliptical or rectangular. The second terminal 50 is also preferably positionable within the cavity of the second housing portion 60 as illustrated in FIG. 3. The second terminal 50 is preferably comprised of a metal material. The second terminal 50 is further preferably comprised of an electrically conductive material. Further, the second terminal 50 and the first terminal 30 are preferably comprised of substantially similar configurations.

The second terminal 50 preferably includes a second outer member 52 and a second inner member 56. The second outer member 52 is preferably comprised of a ring configuration as shown in FIG. 4. The second outer member 52 is further preferably comprised of a hard metal material so as not to bend or deform during or after extended use. An outer diameter of the second outer member 52 is preferably substantially similar to an outer diameter of the cavity 23.

The second outer member 52 preferably includes a second extended portion 54 and a second fulcrum portion 53. The second extended portion 54 preferably extends outwardly form the second outer member 52. The second extended portion 54 is further preferably comprised of a rectangular configuration. The second extended portion 54 is preferably positionable within the second receiving portion 26 of the second housing portion 60.

The second outer member 52 also preferably includes a second connecting aperture 59. The second connecting aperture 59 extends through the second extended portion 54. The second connecting aperture 59 further preferably aligns with the second connecting member 27 and is positionable over the second connecting member 27 thus securing the second terminal 50 within the second housing portion 60. The second outer member 52 also preferably includes a second fulcrum portion 53. The second fulcrum portion 53 preferably extends across the second outer member 52. The second fulcrum portion 53 preferably provides an overlapping region for the second inner member 56 to attach to the second outer member 52.

The second inner member 56 is preferably comprised of a circular configuration. An outer diameter of the second inner member 56 is also preferably slightly less than an inner diameter of the second outer member 52. The second inner member 56 is also preferably comprised of a brass material; however other materials may be utilized with the second inner member 56 rather than the preferred material.

The second inner member 56 is preferably spot welded to the second fulcrum portion 53 of the second outer member 52. Utilizing weld substance as a fastener between the first inner member 56 and the first outer member 52 preferably prevents the first inner member 56 from becoming loose upon the first outer member 52 over extended use. A concentric origin of the second inner member 56 is also preferably substantially similar to a concentric origin of the second outer member 52 when attaching the second inner member 56 to the second outer member 52.

The second inner member 56 also preferably includes a second contact 57. The second contact 57 preferably extends downward from an outer edge of the second inner member 56. The second inner member 56 is also preferably attached to the second outer member 52 in a manner, wherein an electrical current is able to flow between the second contact 57 and the second extended portion 54 of the second outer member 52.

The second inner member 56 also preferably includes a pivot slot 55 positioned on an inside edge of the second fulcrum portion 53 of the second outer member 52 as shown in FIG. 4. The pivot slot 55 preferably allows the second inner member 56 to pivot about the second outer member 52.

The second contact 57 is preferably positioned so that when the second inner member 56 pivots the second contact 57 is able to be positioned against the first contact 37 of the first inner member 36. When the first contact 37 and the second contact 57 are positioned against one another a circuit is preferably completed thus allowing an electrical current to flow from the first extended portion 34 of the first terminal 30 to the second extended portion 54 of the second terminal 50 or vice versa.

The ultra low pressure switch adjustment system 10 also preferably includes a plurality of seal members 42, at least one spacer member 40 and at least one diaphragm member 44. The seal members 42 are preferably comprised of an O-ring configuration. The seal members 42 are further preferably comprised of a rubber material so as to provide a fluid seal within the ultra low pressure switch adjustment system 10. An outer diameter of the seal member 42 is preferably comprised of a substantially similar size and configuration as the outer diameter of the first outer member 32 and the second outer member 52.

The seal members 42 are preferably spaced at various positions within the ultra low pressure switch adjustment system 10 where a fluid seal is desired. The seal members 42 preferably prevent the first pressure and/or the second pressure from escaping the cavity 23 of the housing 20, 60 through the outer wall. The seal members 42 are also preferably able to expand and contract with the housing 20, 60 to consistently provide a fluid seal within the ultra low pressure switch adjustment system 10 for multiple environmental conditions. The seal members 42 also preferably fit within a channel 62 of the first housing portion 20, second housing portion 60 and upper and lower ends of the spacer member 40 as shown in FIGS. 1, 2 and 4. The channels 62 are also preferably formed to receive the seal members 42 to prevent the seal members 42 from moving from side to side.

The spacer member 40 is preferably positioned between the first outer member 32 and the second outer member 52 to prevent and keep a consistent distance between the first outer member 32 and the second outer member 52. The spacer member 40 preferably moves up and down with the terminals 30, 50 and expansion/contraction of the housing 20, 60. The spacer members 40 are preferably comprised of an O-ring configuration. The spacer member 40 is further preferably comprised of a thermoplastic or ceramic material; however it is appreciated that the spacer member 40 may be comprised of various materials rather than the preferred embodiment.

It is appreciated that the number of spacer members 40 utilized depends on the size and configuration of the ultra low pressure switch adjustment system 10. An outer diameter and an inner diameter of the spacer member 40 are preferably comprised of a substantially similar size and configuration as the outer diameter and the inner diameter of the first outer member 32 and the second outer member 52. It is further appreciated that the spacer member 40 may be weldebly attached between the first terminal 30 and the second terminal 50.

The diaphragm member 44 is preferably comprised of a circular configuration. The diaphragm member 44 is also preferably comprised of a material to prevent the passage of the fluid throughout the ultra low pressure switch adjustment system 10 from the first port 21 or the second port 61. The diaphragm member 44 preferably forms a first cavity portion and a second cavity portion within the cavity 23 of the housing 20, 60, wherein the first cavity portion is fluidly sealed from the second cavity portion. An outer diameter of the diaphragm member 44 is preferably comprised of a substantially similar size and configuration as the outer diameter of the second outer member 52. The diaphragm member 44 is preferably attached to an upper end of the second outer member 52 and provides a barrier to prevent the second inner member 56 from pivoting upward.

E. Second Housing Portion

Figure 5:
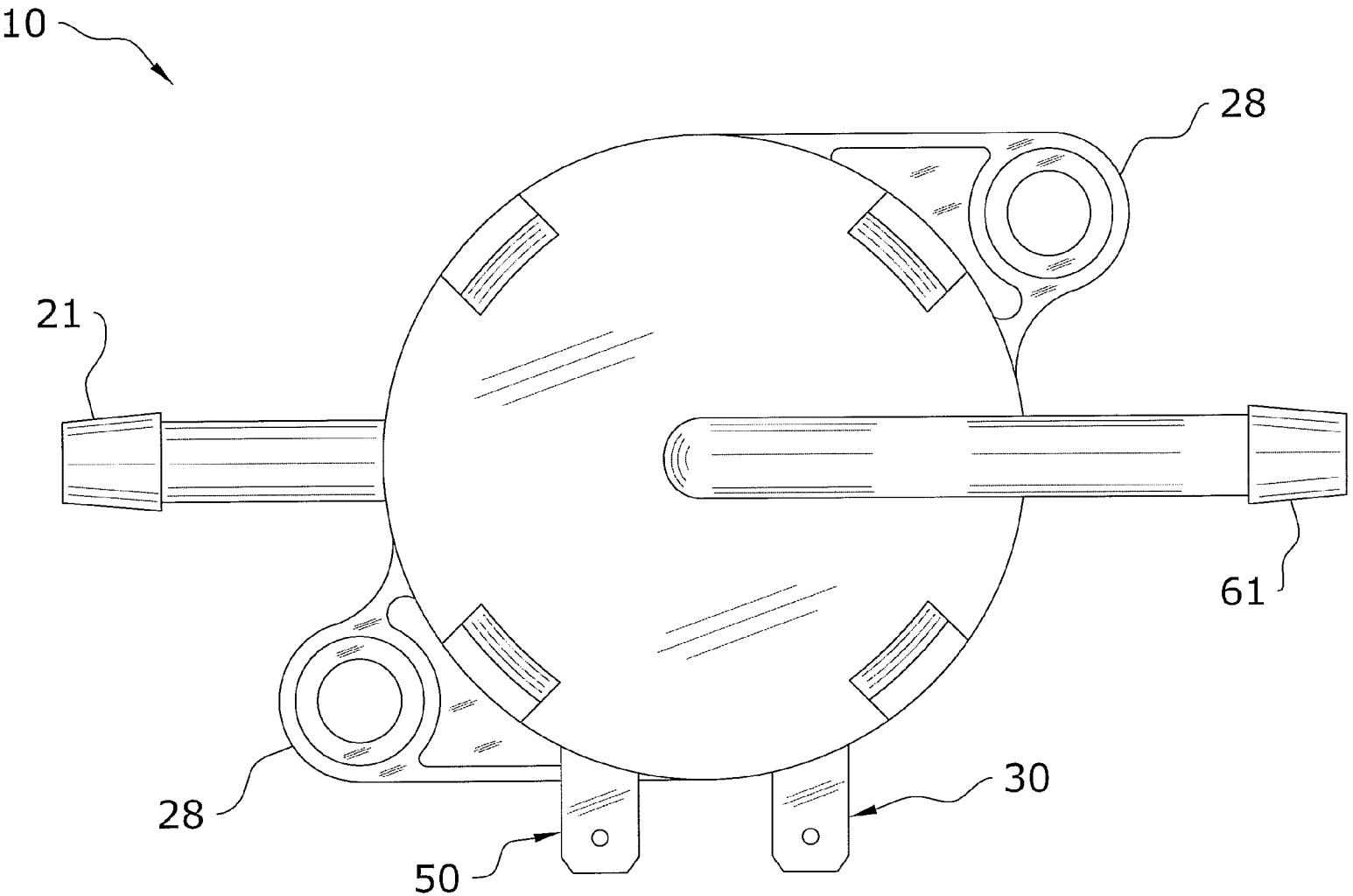
FIG. 5 is a top view of the present invention.

The second housing portion 60 is preferably comprised of a substantially circular configuration as illustrated in FIGS. 3 through 5; however it is appreciated that the second housing portion 60 may be comprised of various configurations rather than the preferred embodiment, such as but not limited to elliptical or rectangular. The second housing portion 60 is preferably comprised of a material to withstand variant temperatures and pressures. The second housing portion 60 is also preferably able to expand and contract accordingly with variant environment conditions. The material of the second housing portion 60 is further preferably comprised of plastic; however other suitable materials may be utilized with the second housing portion 60 rather than the preferred material.

The second housing portion 60 includes a second port 61, wherein the second port 61 preferably receives a second pressure. The second port 61 is preferably comprised of a tubular configuration. The second port 61 also preferably extends horizontally outward from the second housing portion 60 at an opposing side as the first port 21 as illustrated in FIGS. 3 through 5. The second port 61 is also preferably fluidly connected to an inner portion of the second port 61. The second pressure of the second port 61 is preferably comprised of an outwardly blowing pressure.

The second housing portion 60 also preferably includes a plurality of attachment members 63. The plurality of attachment members 63 preferably vertically extend from the second housing portion 60. The plurality of attachment members 63 are also preferably radially positioned substantially near an outer edge of the second housing portion 60 as shown in FIGS. 5 and 6. The attachment members 63 are further preferably positioned to align with the slots 22 of the first housing portion 20.

Each of the attachment members 63 preferably includes a locking portion 64. The locking portion 64 preferably extends out horizontally from the attachment members 63 as shown in FIG. 4. The locking portion 64 is also preferably positioned at a lower end of the attachment members 63. The locking portion 64 preferably extends horizontally beyond a lower end of the slots 22 when the attachment members 63 are positioned within the slots 22. The locking portion 64 further preferably prevent the attachment members 63 and second housing portion 60 from being easily removed from the first housing portion 20.

An outer wall of the second housing portion 60 preferably includes a first connecting portion 66 and a second connecting portion 68. The first connecting portion 66 and the second connecting portion 68 preferably both extend vertically downward from the outer wall of the second housing portion 60 as illustrated in FIG. 4. The first connecting portion 66 is preferably positioned at a substantially lower vertical height than the second connecting portion 68.

The first connecting portion 66 and the second connecting portion 68 are also both preferably comprised of a rectangular configuration; however it is appreciated that first connecting portion 66 and the second connecting portion 68 may be comprised of various embodiments rather than the preferred embodiment. The first connecting portion 66 is preferably substantially similar in size and configuration to the first receiving portion 24. The second connecting portion 68 is also preferably substantially similar in size and configuration to the second receiving portion 26.

Extending vertically upward from the first connecting portion 66 is preferably a first receiving aperture 67. A second receiving aperture 69 also preferably extends vertically upward from the second connecting portion 68. The first receiving aperture 67 preferably receives the first connecting member 25 and the second receiving aperture 69 preferably receives the second connecting member 27.

When the second housing portion 60 is attached to the first housing portion 20 the first extended portion 34 of the first terminal 30 is preferably sandwiched between the first connecting portion 68 and the first receiving portion 24. The second terminal 50 is also preferably sandwiched between the second connecting portion 69 and the second receiving portion 25 when the second housing portion 60 is attached to the first housing portion 20.

F. Assembly of Invention

In assembly, the first housing portion 20 is first positioned so that the cavity 23 faces upward. A first seal member 42 is then positioned within the channel 62 of the cavity 23. The first terminal 30 is then positioned over the first seal member 42, wherein the first connecting aperture 39 of the first terminal 30 is positioned over the first connecting member 25 of the first housing portion 20. A second seal member 42, subsequent spacer member 40 and subsequent third seal member 42 are then positioned over the first terminal 30, wherein the second seal member 42 is positioned within a channel 62 adjacent to the lower end of the spacer member 40 and the third seal member 42 is positioned within the channel 62 adjacent to the upper end of the spacer member 40. It is appreciated that more or less seal members 42 and spacer members 40 may be utilized if desired with the ultra low pressure switch adjustment system 10.

The second terminal 50 is then preferably positioned over the third seal member 42, wherein the second connecting aperture 59 of the second terminal 50 is positioned over the second connecting member 27 of the first housing portion 20. The first terminal 30 is fluidly sealed with respect to the second terminal 50 and the first housing portion 20 via the spacer member 40, second seal member 42 and third seal member 42. The diaphragm member 44 is then attached to the upper end of the second terminal 50 and a fourth seal is then positioned over the diaphragm member 44 and within the channel 62 of the second housing portion 60.

The diaphragm member 44 is preferably fluidly sealed with respect to the second housing portion 60 of the housing 20, 60 defining a first cavity portion within the housing 20, 60. The second terminal 50 is preferably fluidly sealed with respect to the diaphragm member 44. A second cavity portion is formed within the housing between the diaphragm member, the first terminal, the second terminal and the first portion of the housing. The second cavity portion is also preferably fluidly sealed from the first cavity portion.

The second housing portion 60 is then attached to the first housing portion 20 via the attachment slots 22 removably attaching within the slots 22 and the connecting portions 66, 68 removably attaching within the recessed portions 24, 26. The first terminal 30, plurality of seal members 42, spacer member 40, second terminal 50 and diaphragm member 56 are all preferably freely floating within the first housing portion 20 and the second housing portion 60 when the ultra low pressure switch adjustment system 10 is assembled.

The first adjustment member 70 and the second adjustment member 72 are also preferably threadably attached within the first housing portion 20 and are preferably adjusted accordingly to the desired triggering pressure. The free floating structure allows the ultra low pressure switch adjustment system 10 to expand and contract while maintaining a consistent trip point for the first pressure or the second pressure. What has been described is the preferred method of assemblage as illustrated in FIG. 4. Other methods of assemblage may be utilized with the ultra low pressure switch adjustment system 10.

G. In Use

In use, the adjustment member is first adjusted so that the second contact 57 of the second terminal 50 makes contact with the first contact 37 of the first terminal 30 at the desired pressure. Extending the first adjustment member 70 upwardly forces the first inner member 36 of the first terminal 30 upward thus reducing the pressure needed to complete the circuit of the first terminal 30 and the second terminal 50.

Lowering the first adjustment member 70 subsequently lowers the first inner member 36 of the first terminal 30 thus increasing the fluid 12 pressure needed to complete the circuit of the first terminal 30 and the second terminal 50. Extending the second adjustment member 72 upwardly prevents the second inner member 56 of the second terminal 50 from engaging the first inner member 36 of the first terminal 30 and thus from completing the circuit of the first terminal 30 and the second terminal 50 without increasing the fluid 12 pressure.

The closer that the second adjustment member 72 is positioned to the second terminal 50 the more fluid 12 pressure is needed to complete the circuit. The second adjustment member 72 may also be lowered so as not to engage the second terminal 50 if the triggering pressure is desired to be lowered or remain at an initial triggering pressure.

Once the first adjustment member 70 and the second adjustment member 72 are properly positioned within the cavity 23 a pressure hose may be attached to the first port 21 or the second port 61. If the pressure hose is comprised of a vacuum hose the pressure hose is preferably removably attached to the first port 21. The first pressure of the first port 21 pulls the second inner member 56 downward to complete the circuit. If the pressure hose is comprised of a forwardly blowing pressure hose the pressure hose is preferably removably attached to the second port 61. The second pressure of the second port 61 pushes the second inner member 56 downward to complete the circuit.

To remove the second housing portion 60 from the first housing portion 20 an inward force is applied to the attachment members 63 forcing the locking portion 64 of the adjustment members 63 to align with the slots 22 of the first housing portion 20. The second housing portion 60 may now be pulled away from the first housing portion 20 as shown in FIG. 4.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. An ultra low pressure switch, comprising:

a housing including a cavity, a first aperture extending into said cavity and a second aperture extending into said cavity;

a first terminal positioned within said cavity;

a second terminal positioned within said cavity, wherein said second terminal selectively engages said first terminal;

a first adjustment member to engage said first terminal, wherein said first adjustment member extends through said first aperture in an adjustable manner to adjust a position of said first terminal; and a second adjustment member to engage said second terminal, wherein said second adjustment member extends through said second aperture in an adjustable manner;

wherein said first terminal includes a third aperture, wherein said third aperture receives said second adjustment member.

2. The ultra low pressure switch adjustment system of claim 1, wherein said third aperture is positioned substantially concentric with said first terminal.

3. The ultra low pressure switch adjustment system of claim 1, wherein said first adjustment member is perpendicularly positioned with respect to said first terminal.

4. The ultra low pressure switch adjustment system of claim 1, wherein said second adjustment member is perpendicularly positioned with respect to said second terminal.

5. The ultra low pressure switch adjustment system of claim 1, wherein said first adjustment member is threadably attached to said housing.

6. The ultra low pressure switch adjustment system of claim 1, wherein said second adjustment member is threadably attached to said housing.

7. The ultra low pressure switch adjustment system of claim 1, wherein said first terminal includes a first fulcrum portion, wherein said first fulcrum portion forms a first pivot point about said first terminal.

8. The ultra low pressure switch adjustment system of claim 7, wherein said first terminal is pivotally adjusted via said first adjustment member.

9. The ultra low pressure switch adjustment system of claim 1, wherein said second terminal includes a second fulcrum portion, wherein said second fulcrum portion forms a second pivot point about said second terminal.

10. The ultra low pressure switch adjustment system of claim 9, wherein said second inner member pivots about a third pivot point via said second adjustment member.

11. The ultra low pressure switch adjustment system of claim 10, wherein said third pivot point is distally spaced outwardly from said second pivot point.

12. The ultra low pressure switch adjustment system of claim 1, wherein said first adjustment member includes a first upper portion and a first lower portion, wherein said first upper portion is positioned within said cavity and wherein said first lower portion is positioned within a first recessed portion opposite said cavity.

13. The ultra low pressure switch adjustment system of claim 1, wherein said second adjustment member includes a second upper portion and a second lower portion, wherein said second upper portion is positioned within said cavity and wherein said second lower portion is positioned within a second recessed portion opposite said cavity.

14. The ultra low pressure switch adjustment system of claim 1, including a diaphragm member positioned within said cavity, wherein said diaphragm member is positioned adjacent to said second terminal.

15. An ultra low pressure switch, comprising:

a housing including a cavity, a first aperture extending into said cavity and a second aperture extending into said cavity;

a first terminal positioned within said cavity, wherein said first terminal pivots about a first pivot point;

a second terminal positioned within said cavity, wherein said second terminal selectively engages said first terminal and wherein said second terminal pivots about a second pivot point;

a first adjustment member to engage said first terminal, wherein said first adjustment member extends through said first aperture in an adjustable manner to adjust a position of said first terminal; and a second adjustment member to engage said second terminal, wherein said second adjustment member extends through said second aperture in an adjustable manner;

wherein said second terminal pivots about a third pivot point via said second adjustment member, wherein said third pivot point is distally spaced outwardly from said second pivot point.

16. The ultra low pressure switch adjustment system of claim 15, wherein said first terminal includes a third aperture, wherein said third aperture receives said second adjustment member.

17. The ultra low pressure switch adjustment system of claim 15, including a diaphragm member positioned within said cavity, wherein said diaphragm member is positioned adjacent to said second terminal.

18. An ultra low pressure switch, comprising:

a housing including a first aperture and a second aperture, wherein said housing is comprised of a first portion and a second portion, wherein said first portion and said second portion define a cavity between thereof;

a first terminal positioned within said cavity;

a second terminal positioned within said cavity, wherein said second terminal selectively engages said first terminal;

a first adjustment member to engage said first terminal, wherein said first adjustment member extends through said first aperture in an adjustable manner to adjust a position of said first terminal;

a second adjustment member to engage said second terminal, wherein said second adjustment member extends through said second aperture in an adjustable manner;

wherein said first terminal includes a third aperture, wherein said third aperture receives said second adjustment member and wherein said third aperture is positioned substantially concentric with said first terminal;

wherein said first adjustment member is substantially perpendicularly positioned with respect to said first terminal;

wherein said second adjustment member is substantially perpendicularly positioned with respect to said second terminal;

wherein said first adjustment member is threadably attached to said housing and wherein said second adjustment member is threadably attached to said housing;

wherein said first terminal pivots about a first pivot point within said housing;

wherein said first adjustment member pivotally adjusts said first inner member;

wherein said second terminal pivots about a second pivot point within said housing;

wherein said second terminal pivots about a third pivot point via said second adjustment member, wherein said third pivot point is distally spaced outwardly from said second pivot point; and a diaphragm member positioned within said cavity, wherein said diaphragm member is positioned adjacent to said second terminal.

* * * * *